US006048235A

United States Patent [19]

Kai

[11] Patent Number: 6,048,235

[45] Date of Patent: Apr. 11, 2000

[54] TILT DEVICE FOR A MARINE PROPULSION UNIT

[75] Inventor: Shigeru Kai, Saitama, Japan

[73] Assignee: Showa Corporation, Saitama, Japan

[21] Appl. No.: 09/134,293

[22] Filed: Aug. 13, 1998

[30] Foreign Application Priority Data

Nov. 20, 1997 [JP] Japan ..... 9-334786

[51] Int. Cl.[7] ..... B63H 20/08

[52] U.S. Cl. ..... 440/61

[58] Field of Search ..... 440/61; 92/169.1; 60/473

[56] References Cited

U.S. PATENT DOCUMENTS 5,032,094 7/1991 Katogi ..... 440/61

5,049,099 9/1991 Ito et al. ..... 440/61

5,156,561 10/1992 Kinoshita ..... 440/61

FOREIGN PATENT DOCUMENTS 9334786 4/1996 Japan .

*Primary Examiner*—Jesus D. Sotelo

*Attorney, Agent, or Firm*—Dvorak & Orum

[57] ABSTRACT

In a tilt device 20 for a marine propulsion unit, a motor 61 is secured on a valve block 65 through an end plate 72, a tank chamber 75 forms a tank housing 74 covering a yoke 70 of the motor 61, a pump chamber 67 for the pump 62 in the valve block 65 and the tank chamber 75 are interconnected through an oil passage 76 formed in the end plate 72.

3 Claims, 7 Drawing Sheets

TILT DEVICE FOR A MARINE PROPULSION UNIT

BACKGROUND OF THE INVENTION

1. Field of the Invention

The present invention relates to a tilt device for a marine propulsion unit.

2. Description of the Related Art

In the prior art, as described in Japanese Utility Model Registration No.2520691, there is a tilt device for a marine propulsion unit comprising a boat body, a marine propulsion unit tiltably supported on the boat body, and a cylinder device interposed between the boat body and the marine propulsion unit, and in which a hydraulic fluid is controlled to be supplied or discharged from or into a hydraulic fluid supply/discharge device into or from the cylinder device, thereby expanding or contracting the cylinder device so that the marine propulsion unit is tilted. In this prior art, the hydraulic fluid supply/discharge device comprises a motor, a pump, a tank and a passage having a switch valve. The tank and the passage having the switch valve are molded in a valve block, the pump is disposed in a pump chamber provided in the valve block, and the motor is mounted on the pump.

However, the prior art has the following disadvantages.

(1) In addition to the passage having the switch valve and the pump incorporated in the valve block constituting the hydraulic fluid supply/discharge device, a separate tank is provided. Therefore, the hydraulic fluid supply/discharge device must be enlarged in size, and a space occupied by the hydraulic fluid supply/discharge device around the marine propulsion unit is excessively increased.

(2) Since a yoke (outer cylinder) of the motor of the hydraulic fluid supply/discharge device utilizes an electromagnetic force, the yoke is made of iron. However, since the yoke is exposed to the outside, it is necessary that the yoke is subjected to a surface anti-corrosion treatment.

SUMMARY OF THE INVENTION

In a tilt device for a marine propulsion unit, it is an object of the preset invention to make the hydraulic fluid supply/discharge device compact, and to enhance the corrosion resistance of the yoke of the motor.

The present invention comprises a boat body, a marine propulsion unit tiltably supported on the boat body, and a cylinder device interposed between the boat body and the marine propulsion unit, and in which a hydraulic fluid is controlled to be supplied or discharged from or into a hydraulic fluid supply/discharge device into or from the cylinder device, thereby expanding or contracting the cylinder device so that the marine propulsion unit will be tilted. In the tilt device for a marine propulsion unit, there is a hydraulic fluid supply/discharge device having a motor, a pump and a passage having a switch valve, the passage having the switch valve is formed in a valve block. The pump is disposed in a pump chamber provided in the valve block. A mounting seat of a yoke of the motor is secured to the valve block through an end plate of the motor. The yoke of the motor is covered with a tank housing having a shape corresponding to an outline of the yoke of the motor, the tank housing being secured to the end plate of the motor. A space between the tank housing and the yoke of the motor is made as a tank chamber, and the tank chamber and the pump chamber are inter-connected through an oil passage made in the end plate of the motor.

BRIEF DESCRIPTION OF THE DRAWINGS

The present invention will be understood more fully from the detailed description given hereinbelow and from the accompanying drawings of the preferred embodiments of the invention.

In the drawings.

DESCRIPTION OF THE PREFERRED EMBODIMENTS

Figure 1:
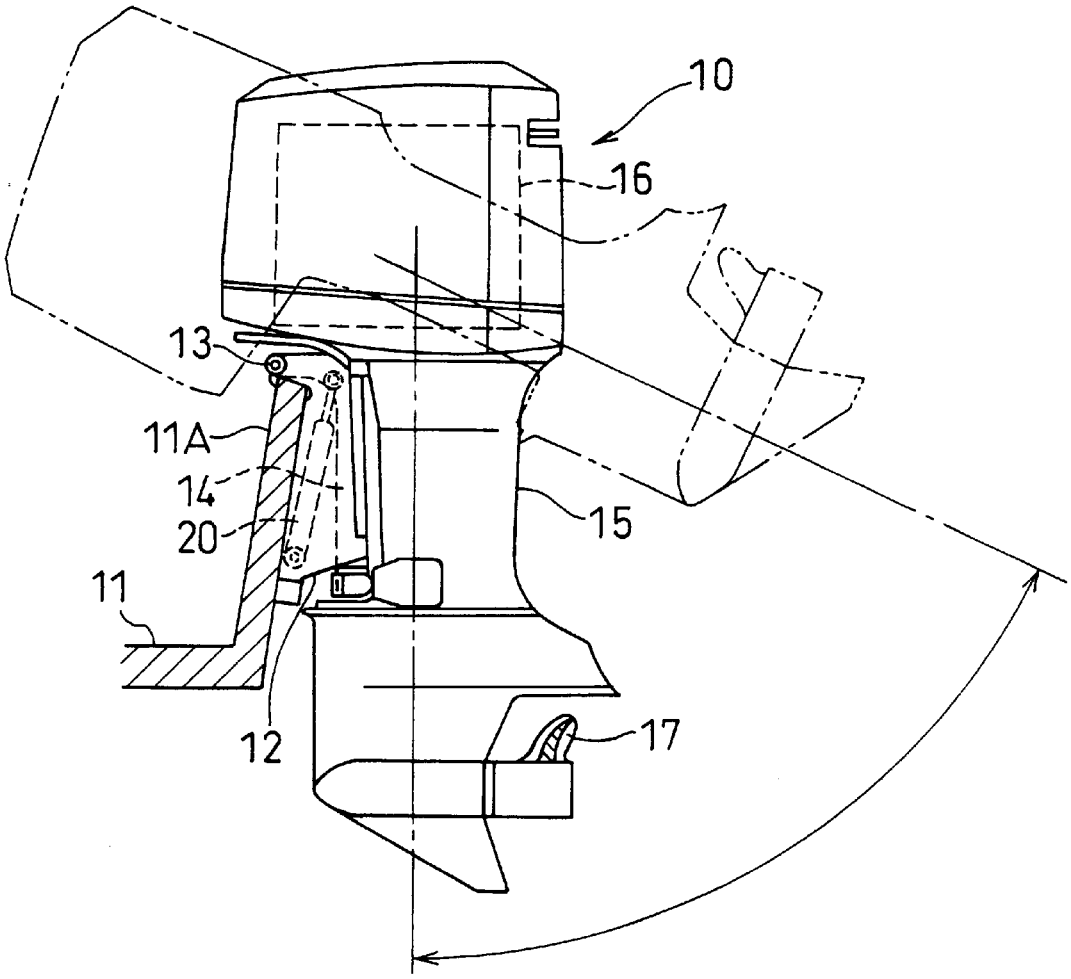
FIG. 1 is a schematic view of a marine propulsion unit.

A marine propulsion unit 10 (it may be outboard motor or inboard motor) is provided with a stern bracket 12 secured to a stern plate 11A of a boat body 11, and a swivel bracket 14 is pivotally connected to the stern bracket 12 through a tilt shaft 13 such that the swivel bracket 14 can tilt around a substantially horizontal axis. A propelling unit 15 is pivotally connected to a swivel bracket 14 through a steering shaft which is not shown and is substantially vertically disposed such that the propelling unit 15 can be turned around the steering shaft. An engine unit 16 is mounted in an upper portion of the propelling unit 15, and the propelling unit 15 is provided at its lower portion with a propeller 17.

The propelling unit 15 of the marine propulsion unit 10 is pivotally supported on the stern bracket 12 secured to the boat body 11 through the tilt shaft 13 and the swivel bracket 14. A cylinder device 21 of the tilt device 20 is interposed between the stern bracket 12 and the swivel bracket 14, and a hydraulic fluid is selectively supplied or discharged from or into a hydraulic fluid supply/discharge device 22 into or from the cylinder device 21, thereby expanding or contracting the cylinder device 21 so that propelling unit 15 can be tilted.

Figure 2:
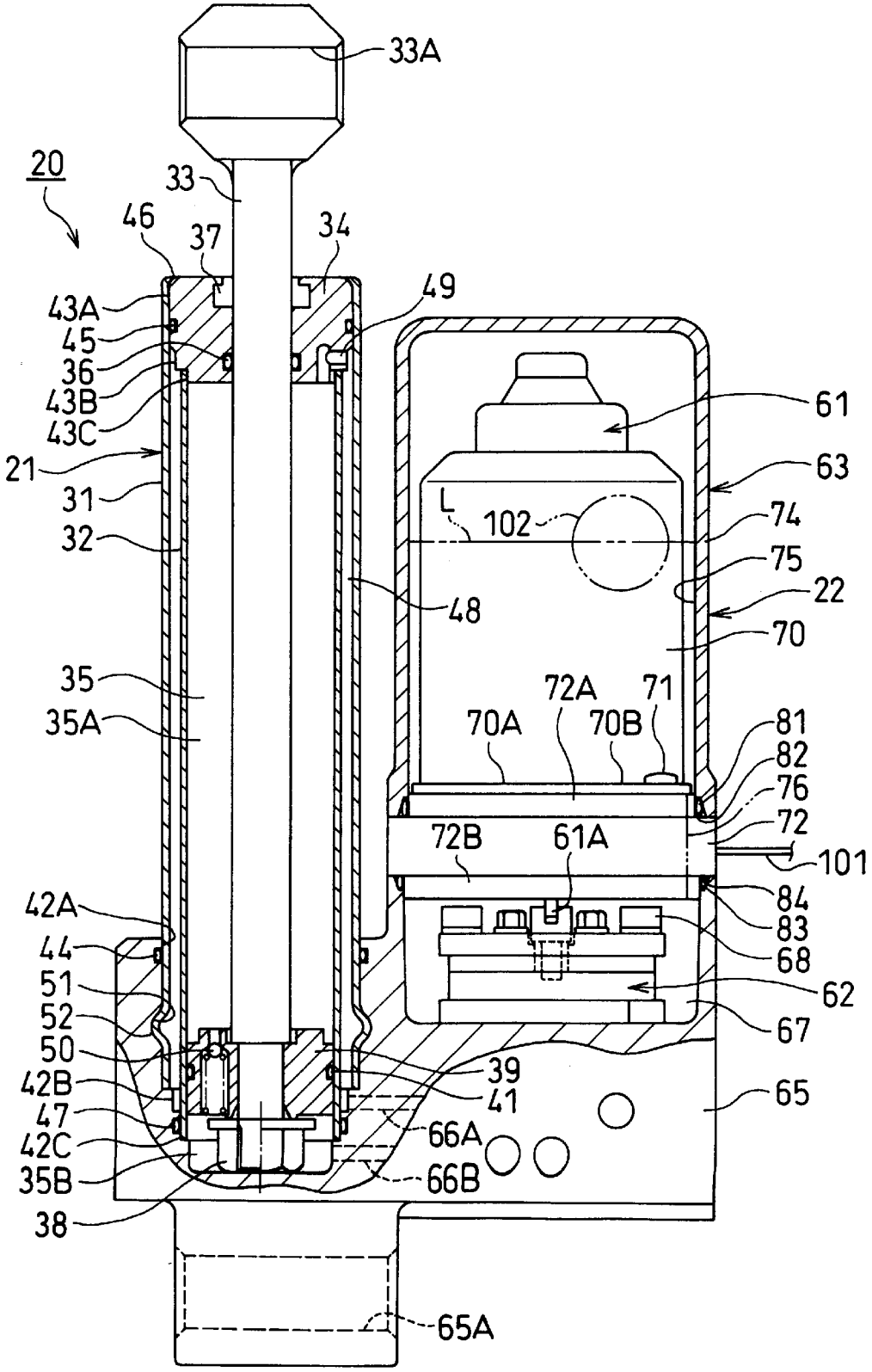
FIG. 2 is a section view of a tilt device.
Figure 3:
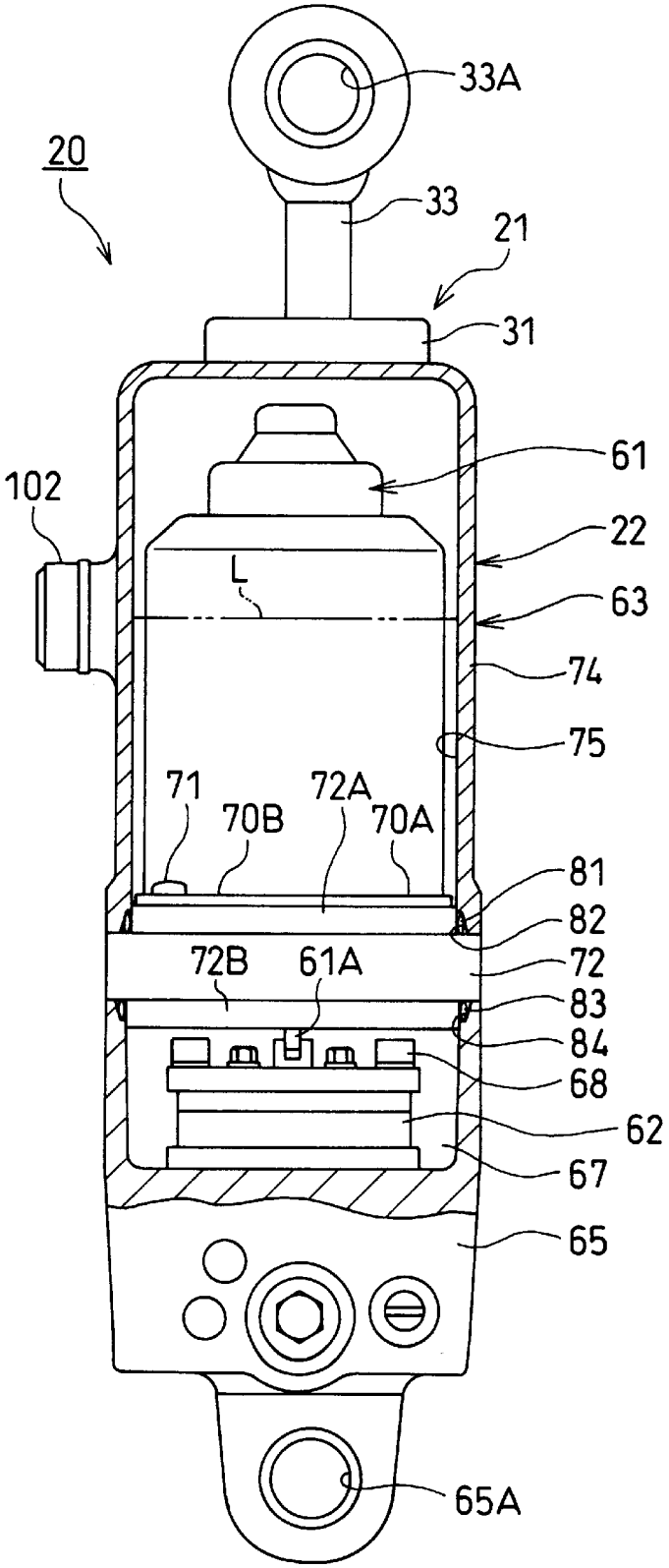
FIG. 3 is a side view of FIG. 2.
Figure 4:
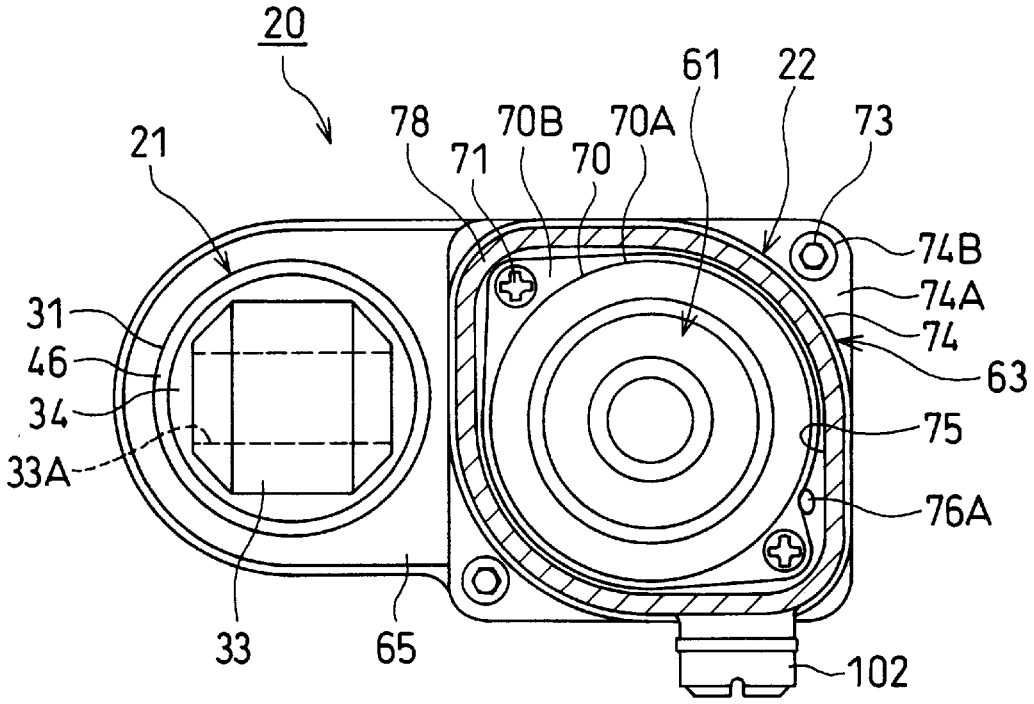
FIG. 4 is a plan view of FIG. 2 with a sectional view of a tank housing.

(Cylinder device 21) (FIGS. 2 to 4)

The cylinder device 21 of the tilt device 20 is integrally coupled to a valve block 65, which will be described later, in a hydraulic fluid supply/discharge device 22. The cylinder device 21 includes an outer cylinder 31 and an inner cylinder 32 which are steel pipes formed by drawing molding, and these cylinders 31 and 32 are integrally coupled to the valve block 65. The valve block 65 can be a cast aluminum alloy, and includes a mounting pin insertion hole 65A for the stern bracket 12.

The cylinder device 21 includes a piston rod 33 which is connected to the swivel bracket 14, and the piston rod 33 is inserted through a rod guide 34 provided at an end of the outer cylinder 31 and into a tilt chamber 35 of the inner cylinder 32 such that the piston rod 33 can be extended and contracted. The rod guide 34 includes a seal member 36 and a water seal 37 such as an O-ring or the like which slidably engage the piston rod 33. The piston rod 33 includes a mounting pin insertion hole 33A for the swivel bracket 14.

Further, the cylinder device 21 includes a piston 39 secured to an end of the piston rod 33 in the tilt chamber 35 of the inner cylinder 32 by a nut 38. The piston 39 includes a seal member 41 such as an O-ring or the like which is slidably in contact with the inner surface of the inner cylinder 32, and divides the tilt chamber 35 into a first tilt chamber 35A which accommodates the piston rod 33 and a second tilt chamber 35B which does not accommodate the piston rod 33.

The cylinder device 21 includes a large diameter hole 42A, an intermediate diameter hole 42B and a small diameter hole 42C which are concentric with the valve block 65, and a large diameter portion 43A, an intermediate diameter portion 43B and a small diameter portion 43C which are concentric with the rod guide 34. One end of the outer cylinder 31 is fitted to the large diameter hole 42A of the valve block 65 through a seal member 44 such as an O-ring, and the other end of the outer cylinder 31 is fitted to the large diameter portion 43A of the rod guide 34 through a seal member 45 such as an O-ring and is secured by a bent portion 46. One end of the inner cylinder 32 is fitted to the small diameter hole 42C of the valve block 65 through a seal member 47 such as an O-ring, and the other end of the inner cylinder 32 is fitted to and secured to the small diameter portion 43C of the rod guide 34. With this structure, a ring-like oil passage 48 is formed between the outer cylinder 31 and the inner cylinder 32, and the first tilt chamber 35A and the oil passage 48 are interconnected through an oil passage 49 which opens at the intermediate diameter portion 43B of the rod guide 34. The oil passage 48 which is in communication with the first tilt chamber 35A interconnects with a first oil passage 66A which is in communication with the intermediate diameter hole 42B of the valve block 65, and the second tilt chamber 35B is connected with a second oil passage 66B provided in the valve block 65.

The piston 39 of the cylinder device 21 includes an extension side buffer valve 50 opens at a set pressure to protect a hydraulic pressure circuit when an impact force is applied in an extension direction of the cylinder device 21 such as when a floating log collides against the propelling unit 15, and the hydraulic fluid in the first tilt chamber 35A is transferred to the second tilt chamber 35B so that the piston rod 33 can be extended.

Here, a structure for coupling the cylinder device 21 to the valve block 65 will be explained.

(1) The large diameter hole 42A of the valve block 65 is provided with a ring groove 51 having an arc section. One end of the outer cylinder 31 is inserted into the large diameter hole 42A, the one end of the outer cylinder 31 is bulged or distended outwardly by a bulge process to form a bulge portion 52, and the bulge portion 52 is engaged with the above-described ring groove 51. The bulge process is conducted, for example, by pressing a resilient member such as urethane insert into the outer cylinder 31 (this can also be done by pressing a liquid charged in the outer cylinder 31, or by enlarging a diameter of a division ring inserted in the outer cylinder 31), so that the outer cylinder 31 is deformed or distended to follow the ring groove 51 of a valve block 65.

(2) An assembly of the inner cylinder 32 is inserted into the outer cylinder 31 which is secured to the valve block 65 by the above process (1), and one end of the inner cylinder 32 is fitted to the small diameter hole 42C of the valve block 65. The assembly of the inner cylinder 32 comprises the piston 39, the piston rod 33, the rod guide 34 and which have been previously assembled, into the inner cylinder 32 before the inner cylinder 32 is inserted into the outer cylinder 31.

(3) A bent portion 46 at the other end of the outer cylinder 31 is secured around the rod guide 34 of the assembly of the inner cylinder 32.

(Hydraulic fluid supply/discharge device 22) (FIGS. 2 to 8)

The hydraulic fluid supply/discharge device 22 comprises a reversible motor 61, a reversible gear pump 62 and a tank 63, and a switching valve 64, which can supply and discharge a hydraulic fluid to and from the first tilt chamber 35A and the second tilt chamber 35B of the cylinder 21 through the first oil passage 66A and the second oil passage 66B provided in the valve block 65.

At that time, the hydraulic fluid supply/discharge device 22 forms a passage having a switch valve 64 on the valve block 65 formed of cast aluminum alloy, and includes the first oil passage 66A, and the second oil passage 66B. The valve block 65 includes a large diameter hole 42A, an intermediate diameter hole 42B and a small diameter hole 42C for integrally forming the cylinder device 21 as described above, and includes a pump chamber 67 at a location adjacent to an integrally coupled portion of the cylinder device 21. The pump chamber 67 accommodates the hydraulic fluid, and includes the pump 62 in a state where the pump 62 soaks in the hydraulic fluid. The pump 62 is secured to the valve block 65 through a bolt 68.

The hydraulic fluid supply/discharge device 22 includes a motor 61 which drives the pump 62 and which is disposed on an upper portion of the pump chamber 67 provided in the valve block 65, and the pump 63 comprises a tank housing 74 for covering the motor 61. The motor 61 comprises an iron yoke or stator 70, and an end plate 72 is connected in a water-tight manner to a lower opening end of the yoke 70 through a seal member such as an O-ring, and is secured thereto by a setscrew. The end plate 72 is provided at its upper and lower sides with upper and lower steps 72A and 72B, respectively. A periphery portion of the pump chamber 67 of the valve block 65 is fitted to the lower step 72B and is connected in a water-tight manner with an O-ring 83. The tank housing 74 is fitted to the upper step 72A and is connected in the water-tight manner with an O-ring 81. The tank housing 74 and the end plate 72 are fastened to the valve block 65 by a bolt 73. Details thereof are described below.

Figure 6:
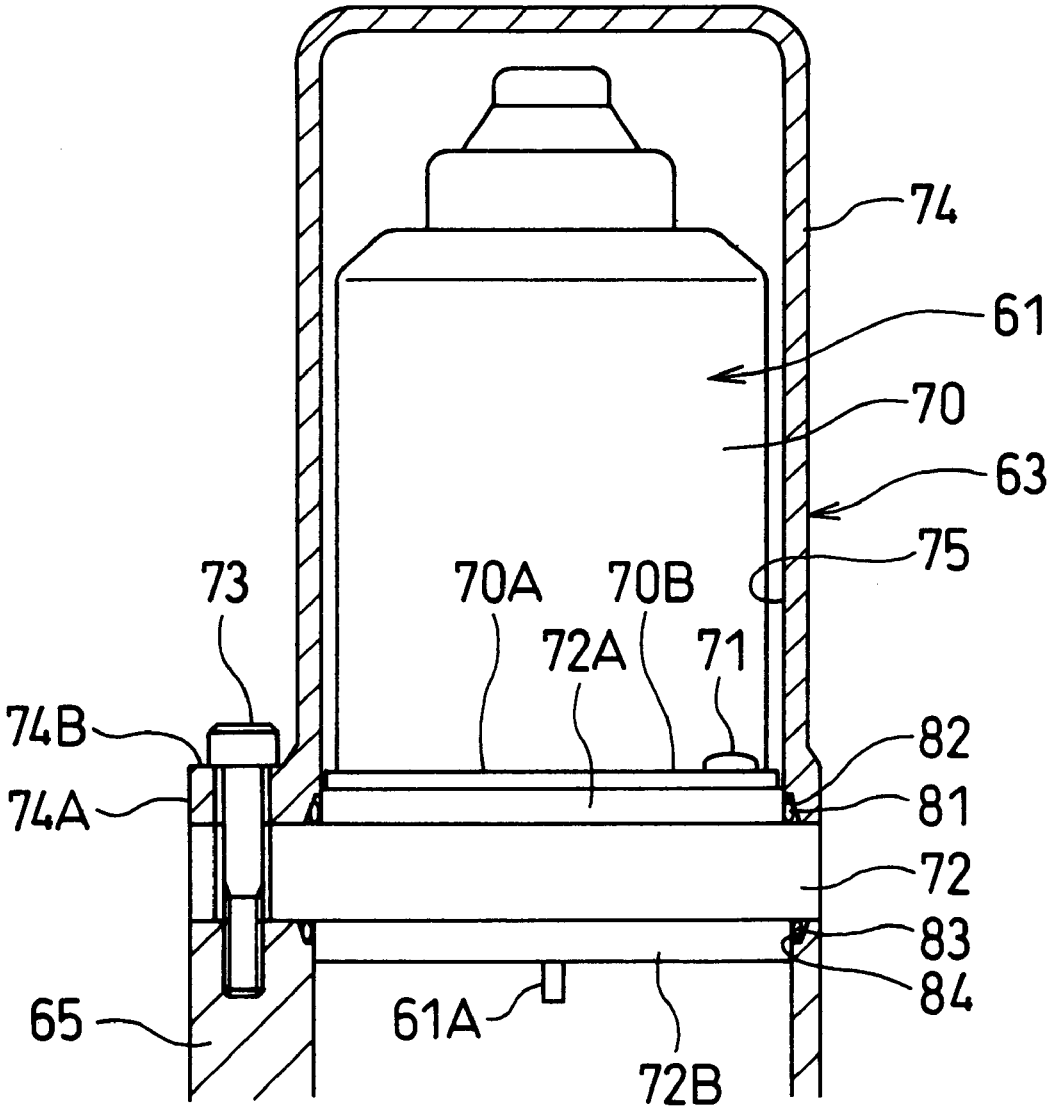
FIG. 6 is a schematic view showing a mounting structure of the tank housing and a motor.

The hydraulic fluid supply/discharge device 22 secures mounting portions 70B (which will be described latter) for mounting a seat 70A of the iron yoke 70 of the motor 61 to an end plate 72, made of synthetic resin, for the motor 61 by setscrews 71. A lead wire 101 of the motor 61 is pulled out from a side of the end plate 72. The end plate 72 of the motor 61 is secured around the pump chamber 67 of the valve block 65 together with the mounting portion 74B of the mounting seat 74A of the tank housing 74 by a bolt 73 as will be described later, to seal the pump chamber 67 (FIG. 6). An output shaft 61A of the motor 61 is passed through the end plate 72 in a water-tight manner and is connected to a follower shaft of the pump 62.

The hydraulic fluid supply/discharge device 22 covers the yoke 70 of the motor 61 with the tank housing 74 made of synthetic resin and having a cylindrical shape with a ceiling corresponding to the outline of the yoke 70 of the motor 61. The tank housing 74 is secured to the valve block 65 together with the end plate 72 of the motor 61 by the bolt 73 to constitute the tank 63. A space between the tank housing 74 and the yoke 70 of the motor 61 is defined as the tank chamber 75. The tank housing 74 is provided at its oil supply port with an oil supply plug 102. In FIGS. 2 and 3, the character "L" indicates an oil level.

In the hydraulic fluid supply/discharge device 22, the end plate 72 of the motor 61 is formed with an oil passage 76, and the tank chamber 75 and the pump chamber 67 are in communication through the oil passage 76. The oil passage 76 comprises an upper oil passage 76A which opens at the tank chamber 75 and a lower oil passage 76B which opens at the pump chamber 67, and theses upper and lower oil passages 76A and 76B are connected (FIG. 7A).

In the hydraulic fluid supply/discharge device 22, the yoke 70 of the motor 61 is formed in a circular shape, and the mounting seat 70A of the yoke 70 is formed into a rhomboid shape having bulged portions in opposite sides of one diametrical direction of the yoke 70, and the opposite bulged portions of the rhomboid shaped mounting seat 70A are the mounting portions 70B which are to be mounted to the end plate 72 by the setscrews 71 (FIG. 4). In the hydraulic fluid supply/discharge device 22, a shape of the section of the tank chamber 75 defined around the yoke 70 of the motor 61 by the tank housing 74 is formed into a rhomboid shape which bulges into opposite sides in one diametrical direction corresponding to the rhomboid shape of the mounting seat 70A of the motor 61, and the tank chamber 75 is expanded by the bulged portions 78.

Figure 5:
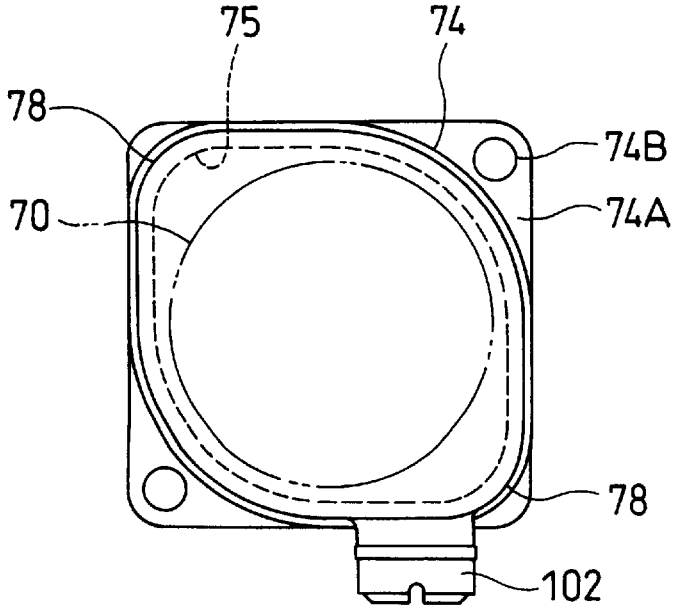
FIG. 5 is a plan view of the tank housing.

Further, in the hydraulic fluid supply/discharge device 22, the mounting portions 74B of the mounting seat 74A of the tank housing 74 which are mounted to the end plate 72 of the motor 61 are provided at opposite sides which cross at right angles with the opposite bulged portions 78 of the tank housing 74. With this structure, the mounting seat 74A of the tank housing 74 is provided, at opposite sides in one of diametrical directions which cross at right angles with each other, with opposite bulged portions 78, and is provided, at opposite sides in the other diametrical direction, with mounting portions 74B. The entire shape of plane projection of the mounting seat 74A is a substantially regular square shape (FIG. 5).

Figure 7A:
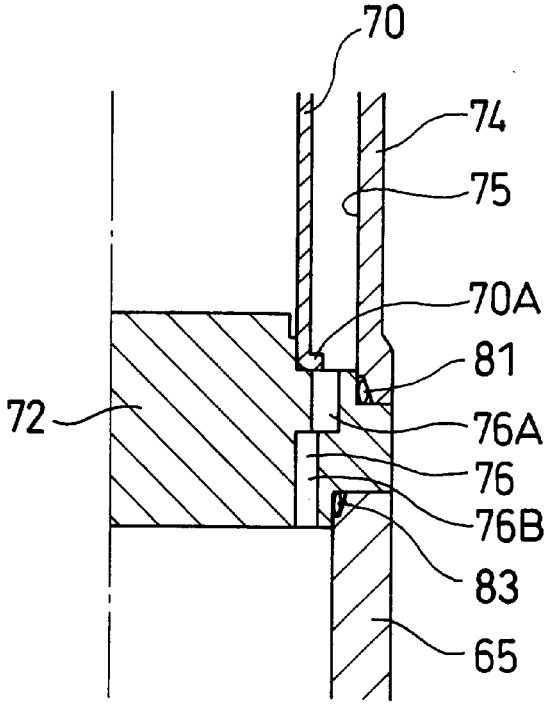
FIGS. 7A and 7B are sectional views showing liquid-tightly sealing structure of the tank housing, an end plate and a valve block.
Figure 7B:
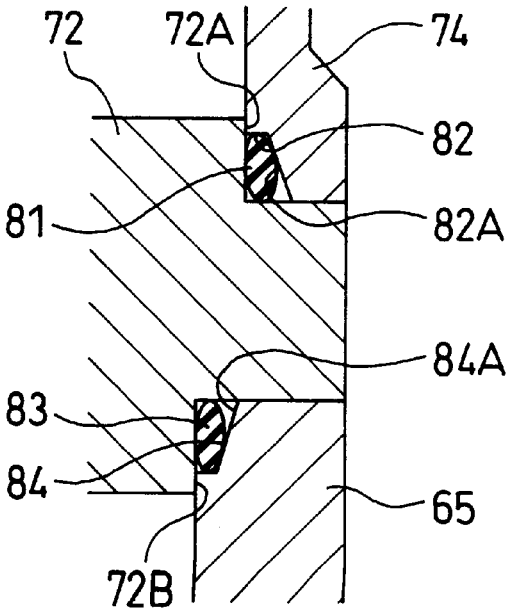
Figure 8:
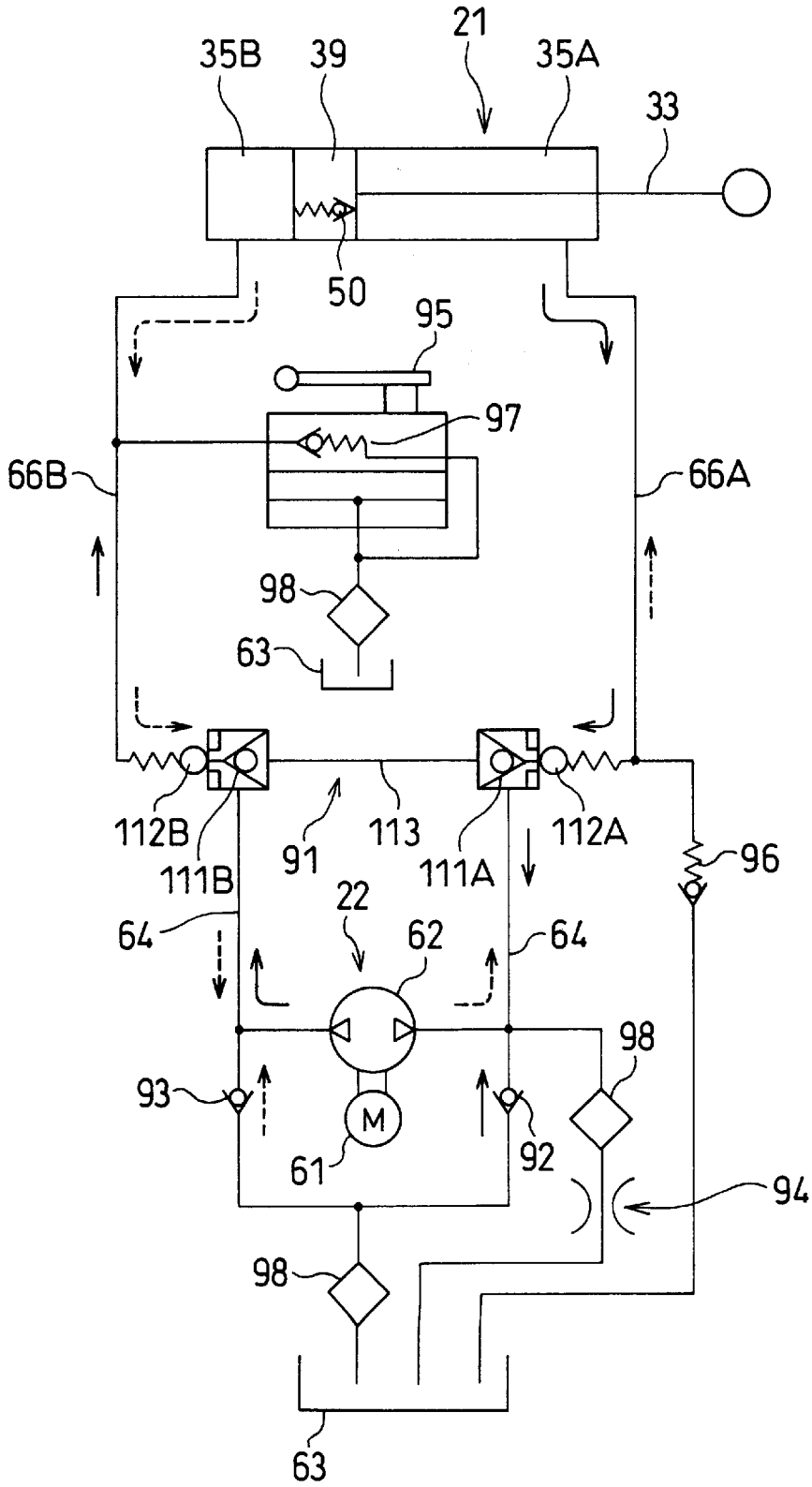
FIG. 8 is a circuit diagram showing a hydraulic pressure circuit of the tilt device.

As shown in FIGS. 7A and 7B, in the hydraulic fluid supply/discharge device 22, an O-ring accommodating groove 82 of the tank housing 74 includes an O-ring pressing surface 82A which gradually increases its diameter toward a fastening direction (downward) of the end plate 72 of the tank housing 74 when the tank housing 74 is fastened to the upper step 72A provided on the end plate 72 of the motor 61 through the O-ring 81 by a fastening force of the bolt 73. With this structure, the O-ring 81 has a large margin for fastening not only in the axial direction but also in the diametrical direction.

Further, in the hydraulic fluid supply/discharge device 22, as shown in FIGS. 7A and 7B, an O-ring accommodating groove 84 around the pump chamber 67 of the valve block 65 includes an O-ring pressing surface 84A which gradually increases its diameter toward a fastening direction (upward) of the end plate 72 of the valve block 65 when the lower step 72B provided on the end plate 72 of the motor 61 is fastened around the pump chamber 67 of the valve block 65 through an O-ring 83 by a fastening force of the bolt 73. With this structure, the O-ring 83 has a large margin for fastening and sealing not only in the axial direction but also in the diametrical direction.

The hydraulic fluid supply/discharge device 22 includes an oil passage 64 having a switch valve which is connected to the first oil passage 66A and the second oil passage 66B, and which comprises a shuttle type switch valve 91, check valves 92 and 93, a down-blow orifice 94, a manual valve 95, a check valve 96, and an up-blow thermal-blow valve 97.

The shuttle type switch valve 91 includes a first check valve 112A and a second check valve 112B located at opposite sides of a first spool 111A having a check mechanism and a second spool 111B having a check mechanism, and the spools 111A and 111B are connected through a passage 113. When the pump 62 is rotated in a normal direction, the first check valve 112A is opened by the oil feeding pressure, and the oil feeding pressure passing through the first spool 111A having the check mechanism moves the second spool 111B having the check mechanism to open the second check valve 112B which is located at the opposite side. When the rotation of the pump 62 is reversed, the second check valve 112B is opened by the oil feeding pressure, and the oil feeding pressure passing through the second spool 111B having the check mechanism moves the first spool 111A having the check mechanism to open the first check valve 112A which is located at the opposite side.

The check valve 92 is interposed between the pump 62 and the tank 63. When the cylinder device 21 is operated to tilt up, the volume in the tilt chamber 35 is increased by an amount of the piston rod 33 retreated and an amount of hydraulic fluid circulated is reduced. Then, the shortage of circulating oil is compensated for from the tank 63 and the pump 62 by the opening operation of the check valve 92.

The check valve 93 is interposed between the pump 62 and the tank 63. When the tilt down of the cylinder device 21 is completed and return oil from the second tilt chamber 35B to the pump 62 has run out, and the pump 62 is further operated, the hydraulic fluid can be supplied from the tank 63 to the pump 62 by the opening operation of the check valve 92.

At the time of tilt down operation of the cylinder device 21,when the volume of the tilt chamber 35 is reduced by a volume of the inserted piston rod 33, and circulating oil of the hydraulic fluid remains, the down-blow orifice 94 returns the remaining hydraulic fluid to the tank 63.

When the tilt device 20 is out of order, the manual valve 95 can be manually operated to return the hydraulic fluid in the second tilt chamber 35B of the cylinder device 21 into the tank 63, and together with the operation of the check valve 96, the cylinder device 21 is manually contracted, and the propelling unit 15 can be manually tilted down.

The check valve 96 can pass hydraulic fluid in the tank 63 into the first tilt chamber 35A of the cylinder device 21 when the manual valve 95 is used, to manually contract the cylinder device 21.

At the time of tilt up operation of the cylinder device 21, when the pump 62 is further operated even if the piston 39 is abutted against the rod guide 34, the up-blow thermal-blow valve 97 exhibits an up-blow function which returns the excessive hydraulic fluid into the tank 63, and a thermal-blow function which releases the increased hydraulic fluid into the tank 63 when the hydraulic fluid in the second tilt camber 35B of the cylinder device 21 and the second oil passage 66B is increased due to a temperature change or the like.

The basic operation of the tilt device 20 will be explained below.

(1) Tilt down

When the motor 61 and the pump 62 are normally rotated, the discharged oil from the pump 62 opens the first check valve 112A of the shuttle type switch valve 91, and also opens the second check valve 112B through the spools 111A and 111B. With this operation, the discharged oil from the pump 62 passes through the first check valve 112A and the first oil passage 66A and is supplied into the first tilt chamber 35A of the cylinder device 21. The hydraulic fluid in the second tilt chamber 35B of the cylinder device 21 passes through the second oil passage 66B and the second check valve 112B and returns to the pump 62 to contract the cylinder device 21 so that the cylinder device 21 is tilted down.

(2) Tilt up

When the motor 61 and the pump 62 are rotated in reverse, the discharged oil from the pump 62 opens the second check valve 112B of the shuttle type switch valve 91, and also opens the first check valve 112A through the spools 111A and 111B. With this operation, the discharged oil from the pump 62 passes through the second check valve 112B and the second oil passage 66B and is supplied to the second tilt chamber 35B of the cylinder device 21, and the hydraulic fluid in the first tilt chamber 35A of the cylinder device 21 passes through the first oil passage 66A and the first check valve 112A and returns to the pump 62 to expand the cylinder device 21 so that the cylinder device 21 is tilted up.

Therefore, according to the present embodiment, the following effects are obtained.

(1) Since the tank chamber 75 is formed by the tank housing 74 covering the yoke 70 of the motor 61, it is unnecessary to provide the valve block 65 with a separate tank 63. Especially, the oil passage 76 extending from the tank chamber 75 in the tank housing 74 to the pump chamber 67 in the valve block 65 is formed in the end plate 72 without piping around the end plate 72 between the tank housing 74 and the valve block 65, so the outer appearance of the hydraulic fluid supply/discharge device 22 is compact as a whole, and space occupied by the hydraulic fluid supply/discharge device 22 around the marine propulsion unit 10 is reduced.

(2) Since the yoke 70 of the motor 61 is covered with the tank housing 74, and is immersed in the hydraulic fluid in the tank chamber 75, the yoke 70 can be made of iron and it is unnecessary to provide corrosion resistance therefor and thus, any surface treatment of the yoke 70 is unnecessary.

(3) The motor 61 is operated in oil in the tank chamber 75 and therefore, a great cooling effect of the motor 61 can be expected. Further, a noise of the operating motor 61 can be eliminated by the hydraulic fluid and the tank 63 and therefore, the silent level of operation of the motor 61 can be obtained.

(4) The shape of section of the tank chamber 75 defined by the tank housing 74 corresponds to the outline of the mounting seat 70A of the yoke 70 of the motor 61, and is formed into rhomboid shape which bulges or protrudes to opposite sides in one diametrical direction. Further, the mounting portions 74B which are to be mounted to the end plate 72 of the motor 61 of the mounting seat 74A of the tank housing 74 are provided at opposite sides in a diametrical direction which crosses at right angles with the opposite bulged portions of the tank housing 74. Therefore, the outline of the tank housing 74 including the mounting seat 74A is accommodated in a fixed region, a space formed between the tank housing 74 and the yoke 70 of the motor 61 is large especially above the mounting seat 70A of the yoke 70 of the motor 69, the outer appearance of the hydraulic fluid supply/discharge device 22 is made compact; the large tank 75 is formed in the tank housing 74; and it is possible to effectively utilize the space occupied by the hydraulic fluid supply/discharge device 22.

(5) The mounting portions 74B of the mounting seat 74A of the tank housing 74 which are mounted to the end plate 72 of the motor 61 are provided only at the opposite sides in the diametrical direction which crosses at right angles with both the opposite bulged portions 78 of the tank housing 74, and the fastening force between the tank housing 74 and the end plate 72 of the motor 61 at a location in a circumferential direction of the tank housing 74 and apart from the mounting portions 74B is weaker than that in the mounting portion. Therefore, the O-ring accommodating groove 82 which is provided in the tank housing 74 is provided with the O-ring pressing surface 82A which gradually increases its diameter toward the fastening direction of the end plate 72 of the tank housing 74, the fastening margin of the O-ring 81 is large not only in the axial direction of the O-ring 81 but also in the diametrical direction thereof. A sufficient liquid seal is obtained by the O-ring 81 for the fastening portion between the tank housing 74 and the end plate 72 in the entire region in the circumferential direction of the tank housing 74. With this structure, a liquid seal is obtained for the fastening portion between the tank housing 74 and the end plate 72 even at a portion away from the mounting portion for the end plate 72 in the circumferential direction of the tank housing 74.

In the present embodiment, the lead wire 101 of the motor 61 is lead out from the side of the end plate 72. Therefore, the lead out portion of the lead wire 101 does not contact the pump chamber 67 and the tank chamber 75, and it is unnecessary to enhance the sealing performance. Since oil does not contact the lead wire 101, it is unnecessary to enhance the resistance against oil, such as by coating.

As described above, according to the present invention, in the tilt device for the marine propulsion unit, the hydraulic fluid supply/discharge device is made compact, and the corrosion resistance of the yoke of the motor is enhanced.

While the preferred embodiments of the invention have been described in detail with reference to the drawings, they are by no means limitative, and various changes and modifications are possible without departing from the scope and spirit of the invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A tilt device for a marine propulsion unit, in which a cylinder device is interposed between a boat body and a marine propulsion unit is tiltably supported on said boat body, a hydraulic fluid is supplied or discharged from or to a hydraulic fluid supply/discharge device to or from said cylinder device, thereby expanding or contracting said cylinder device to tilt said marine propulsion unit, wherein the hydraulic fluid supply/discharge device comprises a motor, a pump, a tank and a passage having a switch valve, said passage having a switch valve is formed by a valve block, said pump being disposed in a pump chamber provided in said valve block, a mounting seat of a yoke of said motor being secured to said valve block through an end plate of said motor, said yoke of said motor being covered with a tank housing having a shape corresponding to an outline of said yoke of said motor, said tank housing being secured to said end plate of said motor, a space between said tank housing and said yoke of said motor being defined as a tank chamber, and said tank chamber and said pump chamber being interconnected through an oil passage formed in said end plate of said motor.

2. A tilt device for a marine propulsion unit according to claim 1, wherein a shape of a section of said tank chamber defined by said tank housing corresponds to an outline of said mounting seat of the yoke of the motor.

3. A tilt device for a marine propulsion unit according to claim 2, comprising a step provided on said end plate of said motor through an O-ring for fastening the tank housing, an O-ring accommodating groove of said tank housing being provided with an O-ring pressing surface which gradually increases its diameter toward a fastening direction to the end plate of said tank housing.

* * * * *